United States Patent [19]

Yolton et al.

[11] Patent Number: 4,544,404

[45] Date of Patent: Oct. 1, 1985

[54] METHOD FOR ATOMIZING TITANIUM

[75] Inventors: Charles F. Yolton, Coraopolis; John H. Moll, Pittsburgh, both of Pa.

[73] Assignee: Crucible Materials Corporation, Pittsburgh, Pa.

[21] Appl. No.: 710,806

[22] Filed: Mar. 12, 1985

[51] Int. Cl.[4] ..... B22D 23/08

[52] U.S. Cl. ..... 75/0.5 C; 264/12; 264/13

[58] Field of Search ..... 75/0.5 C, 0.5 BB; 264/12, 13

[56] References Cited

U.S. PATENT DOCUMENTS 3,963,812 6/1976 Schlienger ..... 75/0.5 BB 4,474,604 10/1984 Nakamura et al. ..... 75/0.5 C

*Primary Examiner*—Wayland Stallard

*Attorney, Agent, or Firm*—Clair X. Mullen, Jr.

[57] ABSTRACT

A method for producing titanium particles suitable for powder metallurgy applications by atomizing a free-falling stream of molten titanium. Prior to atomization the molten titanium is maintained in a crucible lined with a solidified layer of titanium which separates the molten mass of titanium from the crucible interior to protect it against contamination. The bottom of the crucible has a nozzle through which the titanium passes to form the free-falling stream. The nozzle may be likewise lined with a layer of solidified titanium which maintains the molten titanium passing through the nozzle out of contact with the nozzle material further protecting the titanium from contamination. The free-falling stream is contacted by an inert gas jet to atomize the stream into spherical particles, which are solidified and collected.

19 Claims, 2 Drawing Figures

METHOD FOR ATOMIZING TITANIUM

For various titanium, powder metallurgy applications, such as the manufacture of jet engine components, it is desirable to produce spherical titanium particles that may be subsequently hot compacted to full density. Compaction is generally achieved by the use of an autoclave wherein the titanium particles to be compacted are placed in a sealed container, heated to elevated temperature and compacted at high fluid pressures sufficient to achieve full density. For these applications it is desirable that the titanium particles be spherical to insure adequate packing within the container which is essential for subsequent hot compacting to full density. Nonspherical powders, when hot compacted in this manner, because of their poor packing density result in voids throughout the compact, which prevents the achieving of full density by known practices.

It is known to produce spherical particles for powder metallurgy applications of various alloys by providing a molten mass of the alloy within a crucible having a nozzle in the bottom thereof through which the molten alloy passes to form a free-falling stream. The free-falling stream is struck with a jet of inert gas to atomize the molten alloy into spherical particles which are cooled and collected for use in powder metallurgy applications. Because of the highly reactive nature of titanium, conventional atomizing techniques are not suitable for use therewith. Specifically, titanium in molten form reacts with the interior of the crucible and the nozzle associated therewith to contaminate the titanium so that the resulting atomized particles are not of the quality sufficient for final product applications. Crucibles used conventionally for containing molten material for atomization and nozzles for forming the free-falling molten stream for atomization are lined with refractory ceramic materials and all of these materials are sufficiently reactive with titanium to cause undesirable impurity levels therein.

It is accordingly a primary object of the present invention to provide a method for gas atomizing molten titanium to form spherical particles thereof wherein the molten titanium is protected from contamination during the entire atomizing process.

A more specific object of the invention is a method for protecting molten titanium from contamination during atomization thereof by maintaining the molten titanium out of contact with the crucible interior within which the molten titanium is contained prior to atomization.

Figure 1:
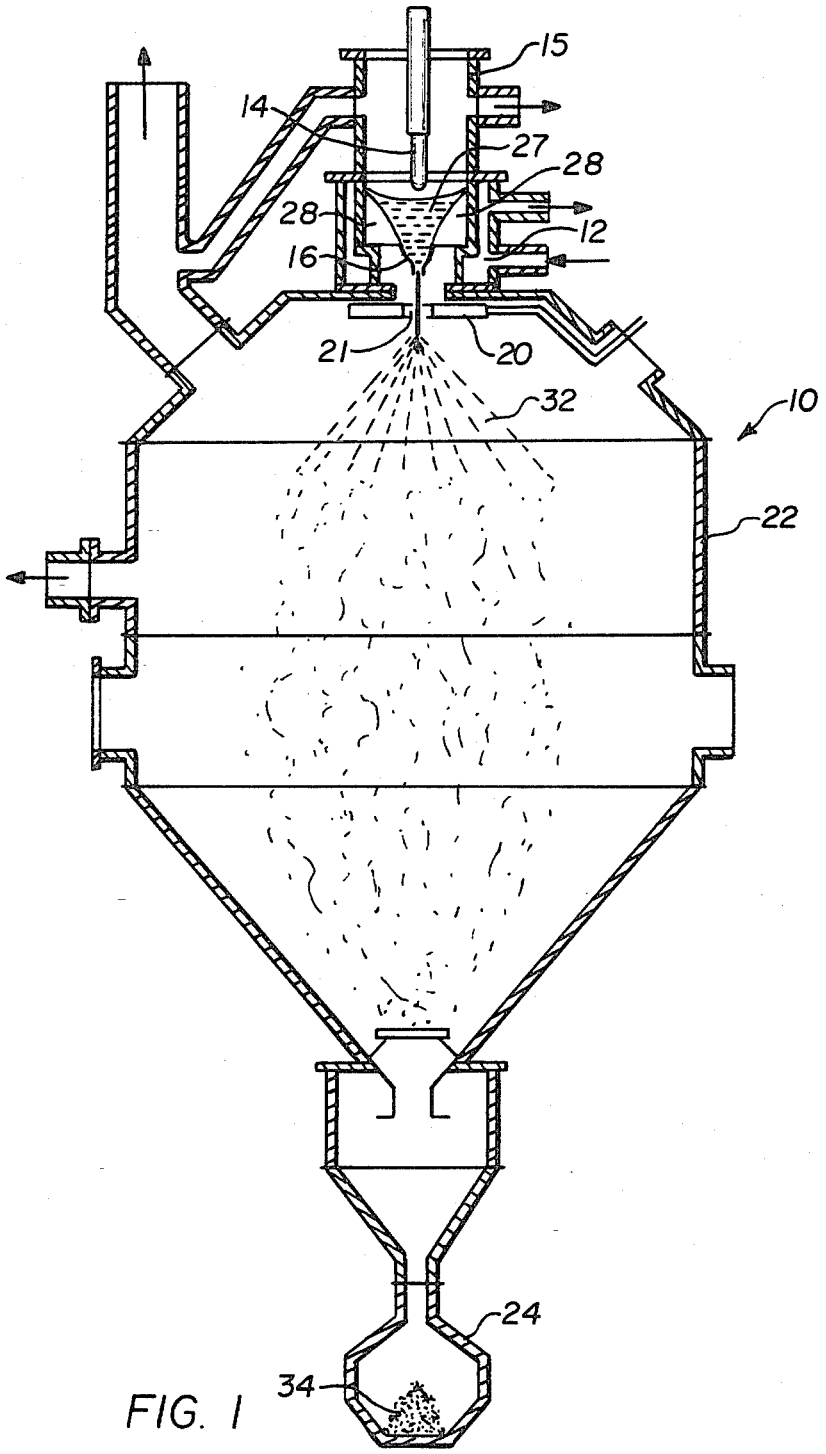
Figure 2:
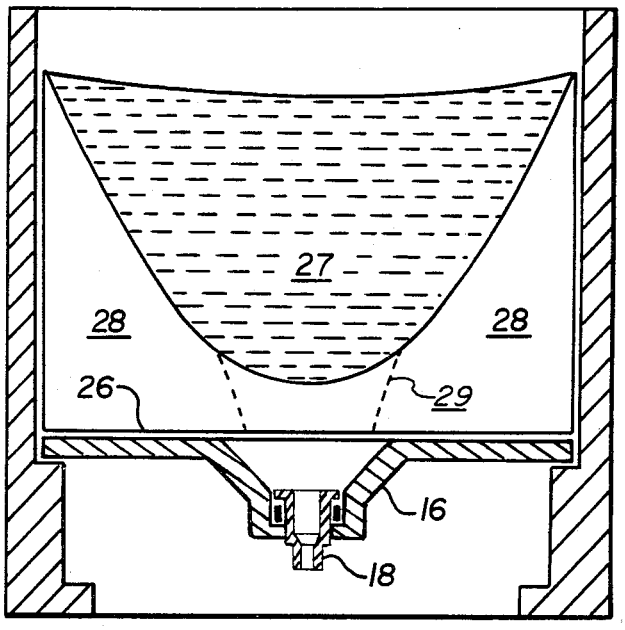

These and other objects of the invention, as well as a more complete understanding thereof, may be obtained from the following description, specific examples and drawings, in which:

FIG. 1 is a schematic showing of one embodiment of apparatus suitable for use with the method of the invention; and FIG. 2 is an enlarged, detailed view of a portion of the apparatus of FIG. 1.

Broadly, the method comprises producing a molten mass of titanium in a water-cooled copper crucible having a nonoxidizing atomosphere therein. The molten mass of titanium is produced by arc melting, and preferably by the use of a nonconsumable electrode, of solid titanium to form a molten mass of titanium within the crucible. The copper crucible is water cooled which forms a layer or skull of solidified titanium adjacent the crucible interior. In this manner, the molten mass of titanium is in contact with this skull of titanium material and out of contact with the interior of the crucible. From the crucible a free falling stream of molten titanium is formed by passing the molten titanium through a nozzle in the bottom of the crucible. Typically, the nozzle would be constructed of a refractory metal such as tungsten, tantalum, molybdenum or rhenium, alone or in combination. The nozzle forms a free-falling stream of the molten titanium which is struck with an inert gas jet to atomize the molten titanium to form spherical particles, which are cooled for solidification and collection. The inert gas jet is adapted to strike the free-falling stream of molten titanium at a distance apart from the nozzle sufficient that the jet and atomized titanium particles do not contact the nozzle to cause erosion thereof or cooling of the molten titanium passing through the nozzle. Cooling of the nozzle in this manner results in partial plugging of the nozzle bore. This diminishes molten titanium flow through the nozzle which impairs atomization. The inert gas used for atomization may be for example argon or helium. The nozzle, which in accordance with conventional practice has a refractory interior, may be likewise cooled to form a solidified skull or layer of titanium therein. In this manner the titanium may be further protected from contamination by contact with the refractory nozzle interior, during passage through the nozzle prior to atomization.

With reference to the drawings, and for the present to FIG. 1 thereof, there is shown a titanium powder atomizing unit designated generally as 10. The unit includes a water-cooled copper crucible 12. A nonconsumable tungsten electrode 14 used to melt a solid charge of titanium is mounted in a furnace 15 atop the crucible 12. The unit also includes at the bottom of crucible 12, as best shown in FIG. 2, a bottom tundish 16 having at the base thereof a nozzle 18. Beneath the nozzle is a ring-shaped inert gas jet manifold 20 which provides a jet of inert gas 21 for atomization purposes. The manifold 20 is contained with an atomizing chamber 22 which may be of stainless steel construction having therein a nonoxidizing atmosphere, such as argon or helium. At the base of the atomizing chamber 22 is a stainless steel canister 24.

In the operation of the apparatus, a charge of titanium in solid form (not shown) is placed within the crucible 12 and rests on a metal rupture disc 26, as shown in FIG. 2. The rupture disc 26 releases the molten titanium at a selected temperature into the tundish 16 and through nozzle 18. After placing the titanium material in solid form in the crucible the system is sealed and evacuated. An arc is struck between the electrode 14 and the charge of solid titanium and melting of the solid titanium is performed until a molten pool 27 is obtained. Cooling of the copper crucible 12 by water circulation causes the retention of a skull or layer of titanium 28 which maintains the molten pool 27 of titanium out of contact with the interior of the crucible. The titanium skull is therefore of the same metallurgical composition as the titanium pool from which it is formed. When the molten pool 27 of titanium is ready to be poured, the electrode 14 is moved closer to the molten pool which drives the pool deeper and melts through the bottom of the skull 28 and rupture disc 26 so that molten titanium from the pool flows into the tundish 16, through the nozzle 18 and forms a free-falling stream as it leaves the nozzle. The melt-through area is indicated by the dash lines 29 in FIG. 2. The free-falling stream is atomized by inert gas jet 21 from the manifold 20 to form particles 32 which solidify within chamber 22 and are collected as solidified particles 34 in canister 24.

By maintaining the skull or solidified layer of titanium within the crucible, and alternately within the nozzle, and by maintaining a protective atmosphere within the atomizing chamber the titanium is protected against contamination while in the molten state and prior to solidification of the atomized particles for collection.

As a specific example of the practice of the invention, an atomization until of the type shown and described herein was used to make spherical powder from a titanium-base alloy of 6% aluminum-4% vanadium balance titanium. A charge of this composition weighing 6.4 lbs (2.9 kg) was placed in the copper crucible after which the furnace and atomization chamber were evacuated to a pressure of 30 millitorr. The chamber and furnace were then backfilled with helium gas to a pressure slightly above atmospheric pressure. An arc was struck between the charge and the tungsten electrode thereby producing a molten pool in the charge. Nominal arc voltage and amperage were 20 volts and 1500 amps. The pool was held for about 4 minutes before bottom pouring through a 0.250 inch (6.3 mm) diameter molybdenum nozzle. The molten stream was atomized with helium gas using a 1.5 inch (38 mm) diameter gas ring with an annular orifice 0.008 inch (0.2 mm) wide. Helium gas pressure was 550 psi (3.8 MPa) as measured at a gas bottle regulator. The atomized product was screened to −20 mesh (U.S. Standard). Size distribution for the −20 mesh product was 24.5% −60 mesh, 6.2% −120 mesh and 1.3% −200 mesh (U.S. Standard). The powder was spherical and had a flow rate of 35 sec (ASTM B213) and a packing density of 63% of theoretical density.

It is understood that the term titanium as used herein includes titanium-base alloys.

We claim:

1. A method for producing titanium particles suitable for powder metallurgy applications, said method comprising producing a molten mass of titanium in a crucible having therein a nonoxidizing atmosphere, maintaining said molten mass of titanium out-of-contact with said crucible, producing a free-falling stream of said molten titanium from said crucible, striking said free-falling stream with an inert gas jet to atomize said molten titanium to form spherical particles, cooling said spherical particles to solidify said particles and collecting said solidified particles.

2. The method of claim 1 wherein said molten mass of titanium is produced in said crucible by arc melting.

3. The method of claim 2 wherein said arc melting is performed by the use of a nonconsumable electrode.

4. The method of claim 1 wherein said molten mass of titanium is maintained out-of-contact with said crucible by providing a solidified layer of titanium between said molten mass and said crucible.

5. The method of claim 4 wherein said crucible has in a bottom portion thereof a nozzle from which said free-falling stream passes, said nozzle being constructed from at least one refractory metal selected from the group consisting of molybdenum, tantalum, tungsten and rhenium.

6. The method of claim 5 wherein said crucible is water cooled.

7. The method of claim 5 wherein said solidified layer of titanium is of the same composition as said molten mass of titanium.

8. The method of claim 7 wherein said inert gas jet strikes said free-falling stream at a distance apart from said nozzle sufficient that said jet and atomized particles do not contact said nozzle to cause erosion of said nozzle and cooling of said molten titanium passing through said nozzle.

9. The method of claim 8 wherein said inert gas is a gas selected from the group consisting of argon and helium.

10. A method for producing titanium particles suitable for powder metallurgy applications, said method comprising arc melting to produce a molten mass of titanium in a crucible having a nonoxidizing atmosphere therein, maintaining said molten mass of titanium out-of-contact with said crucible by providing a solidified layer of titanium between said molten mass and said crucible with said titanium of said solidified layer being of the same composition as said molten mass of titanium, said crucible having in a bottom portion thereof a nozzle from which a free-falling stream of said molten titanium passes from said crucible, an inert gas jet adapted to atomize said molten titanium to form spherical particles by striking said free-falling stream at a distance apart from said nozzle sufficient that said jet and atomized particles do not contact said nozzle to cause erosion of said nozzle and cooling of said molten titanium passing through said nozzle, cooling said spherical particles to solidify said particles and collecting said solidified particles.

11. The method of claim 10 wherein said arc melting is performed by the use of a nonconsumable electrode.

12. The method of claim 10 wherein said crucible is water cooled.

13. The method of claim 10 wherein said inert gas jet is a gas selected from the group consisting of argon and helium.

14. The method of claim 12 wherein said nozzle is constructed from at least one refractory metal selected from the group consisting of molybdenum, tantalum, tungsten and rhenium.

15. A method for producing titanium particles suitable for powder metallurgy applications, said method comprising arc melting to produce a molten mass of titanium in a crucible having a nonoxidizing atmosphere therein, maintaining said molten mass of titanium out-of-contact with said crucible by providing a solidified layer of titanium between said molten mass and said crucible with said titanium of said solidified layer being of the same composition as said molten mass of titanium, said crucible having in a bottom portion thereof a nozzle from which a free-falling stream of said molten titanium passes from said crucible, said nozzle being lined with a solidified layer of titanium of the same composition as said molten mass of titanium, whereby said molten titanium is maintained out-of-contact with said nozzle, an inert gas jet adapted to atomize said molten titanium to form spherical particles by striking said free-falling stream at a distance apart from said nozzle sufficient that said jet and atomized particles do not contact said nozzle to cause erosion of said nozzle and cooling of said molten titanium passing through said nozzle, cooling said spherical particles to solidify said particles and collecting said solidified particles.

16. The method of claim 15 wherein said arc melting is performed by the use of a nonconsumable electrode.

17. The method of claim 15 wherein said crucible is water cooled.

18. The method of claim 15 wherein said inert gas jet is a gas selected from the group consisting of argon and helium.

19. The method of claim 17 wherein said nozzle is constructed from at least one refractory metal selected from the group consisting of molybdenum, tantalum, tungsten and rhenium.

* * * * *